US006212342B1

(12) United States Patent
Fritz

(10) Patent No.: US 6,212,342 B1
(45) Date of Patent: Apr. 3, 2001

(54) WEIGHTED NOISE REDUCING DEVICE FOR PHOTOSENSITIVE DRUM OF AN IMAGE FORMING APPARATUS

(75) Inventor: Rick Fritz, Virginia Beach, VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 0 days.

(21) Appl. No.: 09/372,125

(22) Filed: Aug. 11, 1999

(51) Int. Cl.[7] ..... G03G 15/00
(52) U.S. Cl. ..... 399/91; 399/159
(58) Field of Search ..... 399/91, 116, 117, 399/159

(56) References Cited

U.S. PATENT DOCUMENTS

| | | | | |
|---|---|---|---|---|
| 5,151,737 | | 9/1992 | Johnson et al. . | |
| 5,430,526 | * | 7/1995 | Ohkubo et al. | 399/159 |
| 5,581,329 | | 12/1996 | Kosmider et al. . | |
| 5,722,016 | | 2/1998 | Godlove et al. . | |
| 5,960,236 | * | 9/1999 | Zaman et al. | 399/91 |

FOREIGN PATENT DOCUMENTS

| | | | | |
|---|---|---|---|---|
| 63-60481 | * | 3/1988 | (JP) | 399/159 |
| 64-31161 | | 2/1989 | (JP) . | |
| 3-105348 | | 5/1991 | (JP) . | |
| 5-35166 | * | 2/1993 | (JP) | 399/159 |
| 5-35167 | * | 2/1993 | (JP) | 399/159 |
| 5-188839 | * | 7/1993 | (JP) | 399/159 |

* cited by examiner

*Primary Examiner*—William J. Royer
(74) *Attorney, Agent, or Firm*—Oblon, Spivak, McClelland, Maier & Neustadt, P.C.

(57) ABSTRACT

A device and method for reducing noise and/or vibration in an image forming apparatus. In a preferred form, an insert is disposed inside of a photosensitive drum, and the insert is a hollow tubular member including an elastic member having, in a relaxed state, an outer diameter larger than an inner diameter of the said inner surface of the photosensitive drum. The elastic member is configured such that when it is elongated in a longitudinal direction, the outer diameter of the elastic member may be elastically reduced to a diameter equal to or less than the inner diameter of the photosensitive drum, and after insertion, the overall diameter of the insert can be increased such that the outer surface of the insert comes into contact with an inner surface of the drum. As such, the insert can be anchored to the interior of the drum without using adhesive and can be easily removed for recycling purposes.

38 Claims, 6 Drawing Sheets

WEIGHTED NOISE REDUCING DEVICE FOR PHOTOSENSITIVE DRUM OF AN IMAGE FORMING APPARATUS

TECHNICAL FIELD

The invention relates to an image forming apparatus, and particularly to photosensitive drums in which an insert is provided for reducing noise and/or vibration.

BACKGROUND OF THE INVENTION

Discussion of Background

Image forming apparatuses, such as printers or photocopiers, include a photosensitive member, typically in the form of a photosensitive drum. The performance of the photosensitive drum is of critical importance, since the image being produced (or reproduced) is formed and developed on the drum surface. The developed image is then transferred from the drum to, for example, a sheet of paper. Typically, the drum is formed of metal, such as aluminum, and the metal is anodized or coated with a thin dielectric layer. Normally, the drum is then coated with photogeneration and photoconduction layers over the dielectric layer.

In forming an image, the drum is rotated, and a given location on the outer surface of the drum is thereby rotated past a charging device, an exposure location, a developing location (at which toner is applied), a transfer location (at which the toner image is transferred from the drum to paper), and a cleaning location at which a cleaning blade removes excess toner from the drum so that the process can be repeated. During an image forming operation, as a result of the rotation of the photosensitive drum and its interaction with the various other components of the image forming apparatus, noise and vibration can occur. This is particularly true since the photosensitive drum is a thin-walled metal drum, and thus has a characteristic harmonic sound spectrum which is easily driven by any mechanical resonance.

For example, vibration (and associated noise) can occur from the rotation of the drum, and any imperfections of the drum, the gear flanges attached to the drum, and/or the drive which interacts with the gear flanges of the drum. Further, an alternating current (AC) electric field is applied to the charge roller, and the alternating current can also cause noise and/or vibration of the drum or between the drum and other components. In addition, as the drum rotates past the cleaning blade (which is in contact with the drum), noise is often generated, particularly if the drum surface is roughened by use. This interaction between the drum and cleaning blade is also known as chatter vibration or "stick-slip" vibration. (See, e.g., Chatter Vibration of a Cleaner Blade in Electrophotography, by Kawamoto, in the January/February 1996 issue of Journal of Imaging Science and Technology.) The noise and vibration associated with operation of a photoconductive drum not only presents an annoyance to workers using (or in the vicinity of) the image forming apparatus, but also, the noise/vibration can lead to image deterioration or damage to the apparatus. In particular, the vibration can result in poor performance or interaction between the photosensitive drum and one or more of the components with which the drum interacts, including the cleaning blade, the charge roller, the developer device, etc.

Vibration may also cause image blurring especially with the current trend to higher resolution devices (evolution from 300 to greater than 1200 dots per inch). For example, if the cleaning blade does not properly remove residual toner, undesirable resolution of character images can occur in subsequent images. Further, if the drum is not charged or developed properly, the resulting image can have white spaces where the image has not been properly formed, developed or transferred, or black spots where undesired toner has been transferred to the sheet of paper. Noise problems can also occur as a result of the generation of gases (ozone) which occurs during an image forming operation, however this noise is typically relatively small.

To eliminate noise and/or vibration, the physical characteristics of the drum can be modified, for example, by increasing the thickness of the drum. Thus, the drum can be designed so that its natural frequency differs from that of other components of the apparatus and/or that of the process cartridge (the unit within which the drum is disposed). As a result, the vibrations are eliminated or reduced, or the frequency of the noise which might occur can be shifted so that it is outside of the audible range. However, increasing the thickness of the drum can make the drum more expensive to manufacture, particularly if the tooling utilized to manufacture a drum must be replaced. Moreover, when photosensitive drums are manufactured as replacement parts, they will often be inserted into process cartridges of another manufacturer. The process cartridge could be refurbished or a newly manufactured replacement process cartridge of a different manufacturer than that of the photosensitive drum, and the manufacturer/refurbisher of the process cartridge could change (or the design of a given manufacturer/refurbisher could change). Thus, it can be difficult to simply select a thickness of the drum which will be suitable for avoiding noise problems, since even if a thickness is selected for a certain process cartridge, that thickness could be unsuitable for another process cartridge. As a result, noise problems can be particularly problematic with photosensitive drums manufactured as replacement parts.

A further difficultly which can arise with photosensitive drums is that the roundness or circularity of the drum can vary over time, which can also lead to image deterioration. The roundness or circularity of the drum can more rapidly deteriorate if the drum is vibrating and contacting other components disposed about the drum. This problem can also be reduced by providing a thicker drum, however as discussed above, increasing the thickness of the drum can increase the cost, from a materials standpoint and/or the requirement for new tooling.

An alternate solution which has been utilized in the past for solving noise and/or vibration problems has been to insert plugs within the photosensitive drum. U.S. Pat. No. 5,488,459 to Tsuda et al. discloses an example of such an approach. With this solution, a disk or cylindrical object is inserted into the drum, and the insert provides additional weighting to the drum to alter the mass/frequency characteristics of the drum. However, the use of plug-type inserts is undesirable for a number of reasons. First, the plug is often required to be positioned at a precise location within the drum, which can complicate the manufacturing process. Further, the plug must be secured in place, which can require the use of an adhesive, thus further complicating the manufacture/assembly process. Further, the plug must be precisely manufactured. If it is too large, it could cause deformation of the drum, or require a high insertion force, which complicates the assembly process.

For example, it is ideal to use expanding chucks to hold a photoconductive drum by its inner surface during certain manufacturing processes, since damage to the outer surface of the drum is prevented. However, expanding chucks have limited holding ability. Therefore, if a high insertion force is required to insert a plug into a photoconductive drum, it may not be possible to use an expanding chuck to hold the drum during insertion without distorting the shape of the drum. On the other hand, if the plug is too small, it can be difficult to position the plug within the drum and secure the plug in place. Thus, the use of a plug or weight which is inserted inside of the drum has been less than optimal.

Another problem that has arisen with respect to inserts that are bonded to the inside of a photoconductive drum, is that in recycling such equipment, dissimilar materials must be separated from each other. For example, photoconductive drums are typically made from aluminum, while inserts are typically made of rubbers, plastics or foams, etc. Therefore, in order to recycle the drum, the drum must be separated from the insert. If, however, the insert has been bonded to the inside of the photoconductive drum with an adhesive, extreme measures must be taken to remove the insert from the drum.

Similar problems arise with respect to the mounting of end pieces to a photosensitive drum, such as gears and/or flanges. For example, if a gear is attached to the end of a photosensitive drum, to provide an interface with a toothed gear of a motor, and thereby transmit rotational forces to the drum, the gear must be anchored with sufficient strength to withstand such rotational forces over its useful life span. It has been well-known to use adhesives, or to cut an end of the drum to provide a keyway, or other mechanical interlacing techiniques to attach a gear to a drum. However, the use of adhesives causes problems discussed above with respect to drum inserts. Furthermore, specialized machining of the drum ends may require special tooling.

In view of the foregoing, a device and method are needed for reducing noise and/or vibration in image forming apparatus, particularly noise and/or vibration associated with operation of a photosensitive drum. Such a device and method are preferably suitable for use in both original equipment and for replacement parts.

SUMMARY OF THF INVENTION

It is an object of the present invention to provide a device and method for reducing noise and/or vibration in an image forming apparatus.

It is another object of the invention to provide a device and method for eliminating or reducing noise or vibration which can occur during operation of a photosensitive drum in original equipment of an image forming apparatus, or during operation of replaced or refurbished parts of an image forming apparatus.

It is a further object of the invention to provide a device and method which will provide for more reliable and consistent performance of a photosensitive drum in an image forming apparatus.

It is a further object of the invention to provide an insert device for a photosensitive drum which can be easily installed inside of a photosensitive drum, without requiring the insert to be bonded within the drum.

It is yet another object of the invention to provide a drum with an insert and an end piece such as a gear and/or flange which does not require adhesive or special machining of the drum to anchor the end pieces or the insert to the drum.

Another object of the invention is to provide an insert for a photoconductive drum which can be inserted and removed without damaging the photoconductive drum.

The above and other objects and advantages are achieved in accordance with the present invention by providing a noise prevention device inserted into a photosensitive drum and which is constructed of an elastic member having, in a relaxed state, an outer diameter which is larger than an inner diameter of the inner surface of the photosensitive drum. According to the invention, the insert is configured such that when the elastic member is elongated in a longitudinal direction, the outer diameter of the elastic member may be elastically reduced to a diameter equal to or less than the inner diameter of the photosensitive drum. Therefore, the insert may be installed to the interior of a photosensitive drum by elongating the insert then releasing the insert so that it expands in to contact with the inner surface of the drum such that a pressure contact between the insert and the drum increases, since the outer diameter of the insert, in a relaxed state, is larger than the inner diameter of the drum. The inner diameter, outer diameter and material used for constructing the insert are chosen such that, in a relaxed state, and after being inserted into the photoconductive drum, the insert provides sufficient force or pressure contact against the inner surface of the drum such that the insert is anchored to the inside of the drum. Therefore, the complications associated with using adhesive to bond an insert to the interior of a photosensitive drum are avoided and recycling of the drum is simplified since the insert may be removed relatively easily. Furthermore, since the insert can be inserted with little or no insertion force, the drum is rendered more durable and less susceptible to deformation or deviation in roundness about the circumference of the drum.

In a presently preferred form of the invention, the insert is made from an elastomeric material and is structured such that when it is elongated in a longitudinal direction, the outer diameter can be reduced within the elastic range of deformation of the insert such that the outer diameter of the insert can be made smaller than the inner diameter of the drum. Furthermore, the outer diameter of the insert in a relaxed state, is such that a frictional force between the outer surface of the insert and the inner surface of the drum, maintains the radially outward force necessary for anchoring the insert within the photosensitive member. The present invention therefore avoids the need for adhesive and provides an insert that is relatively simple to insert into and remove from a photosensitive member, with little or no insertion force.

Preferably, the elastic member is in the form of a corrugated sleeve, where the outer diameter of the sleeve is larger than the inner diameter of the photosensitive drum. By constructing the insert as such, upon elongation, the folds forming the corrugated sleeve are easily flattened, thereby allowing the outer diameter of the sleeve to be easily reduced, which simplifies insertion and reduces forces necessary for insertion. Additionally, the corrugated sleeve may include at least one closed end. By providing the sleeve with at least one closed end, the insert can be elongated by inserting a tool into an end of the insert opposite the closed end, then pressing the tool against the closed end, so as to elongate the insert. Since the insert is configured such that the outer diameter of the insert can be elastically reduced to be smaller than the inner diameter of the drum, at least a portion of the elastic member can be elongated such that the inner diameter of the elastic member is constricted, thereby allowing the elastic member to be inserted into the drum with little or no insertion force. Once the pressure from the tool is released, the outer surface of the elastic member is pushed against the inner surface of the drum, thereby anchoring the insert within the drum. Similarly, in order to remove the insert, the tool can be inserted into the same position as during insertion, and pushed until the insert is completely removed from the drum. Therefore, insertion and removal can be performed by inserting a tool into the same end of the drum, thereby simplifying insertion and removal procedures.

According to a further aspect of the present invention, a method for inserting an elastic insert into a photosensitive drum includes the steps of elastically elongating an insert which has an outer diameter that is greater than an inner diameter of a photosensitive drum, such that an outer diameter of the insert is contracted to a diameter that is less than an inner diameter of the photosensitive drum. The insert is then inserted into the drum and released so as to allow the insert to return to a relaxed state, and thereby increase a contact pressure between the insert and the inner surface of the drum.

According to another aspect of the present invention, a tool includes first and second engaging devices which are commonly connected to a controlling device. The controlling device is configured to move the first and second engaging devices relative to each other. In a presently preferred embodiment, the engaging devices are configured to engage first and second ends of an inner surface of an elastic insert for a photoconductive member, and the controlling device is configured to move the first and second engaging devices relative to each other along a first direction, so that the elastic insert can be stretched. With such a tool, an elastic insert, such as the inserts described with respect to the above aspects and embodiments of the present invention, can be inserted into a photoconductive member, such as a photoconductive drum. Preferably, the controlling device is configured to move the first and second engaging devices with sufficient force so as to elongate an elastic insert such that an outer diameter of the insert is reduced to a diameter less than the inner diameter of the drum.

The arrangement of the present invention is advantageous in a number of respects. First, since the outer surface of the insert is in contact with the inner surface of the photosensitive drum, the insert can vary the mass/frequency characteristics of the drum, to thereby ensure that the resonance frequency of the drum is outside of the audible range, or does not match the resonance frequency of other components of the apparatus. Further, since the elastic member of the noise prevention device can be elongated so as to have a diameter less than that of the inner surface of the drum, the noise prevention device can be inserted with little or no insertion force, thereby preventing damage during the assembly of the drum with the noise prevention device. A further advantage is that the drum and insert material can be easily recycled, since it is not necessary to use an adhesive to bond the insert with the interior of the drum.

Additionally, during transportation of photosensitive drums from a manufacturer to a downstream user, assembled photosensitive drums may be exposed to temperatures between −20° C. and 40° C. or even temperatures as extreme as −40° C. to 80° C. The exposure of drums to such thermal cycling has caused photosensitive drum inserts to become dislodged from the inner surface of the drum, thereby changing the characteristics of noise suppression in the image forming apparatus during use. For example, such thermal cycling has caused an insert to drop completely out of a photosensitive drum if the end of the drum is not closed with a gear for example. If the drum includes a gear or flange attached to the end thereof, the insert may move within the drum thereby changing the noise dampening effect of the insert. Additionally, the movement of the insert may damage the gear and/or flanges provided at the ends of the drum. Although adhesives have been used in the past to ensure the positioning of an insert within a drum, differences in the coefficients of thermal expansion between the adhesives, the insert, and the drum have caused adhesives to rupture during cyclic thermal encountered during transportation of drums. Therefore, by removing the need for adhesives to maintain the position of the insert within a photoconductive drum, the present invention is not affected by problems caused by adhesive that has been ruptured by thermal cycling.

BRIEF DESCRIPTION OF THE DRAWINGS

Other objects and advantages of the present invention will become apparent as the same becomes better understood with reference to the following detailed description, particularly when considered in conjunction with the drawings in which.

DETAILED DESCRIPTION OF THE PREFERRED EMBODIMENTS

Figure 1:
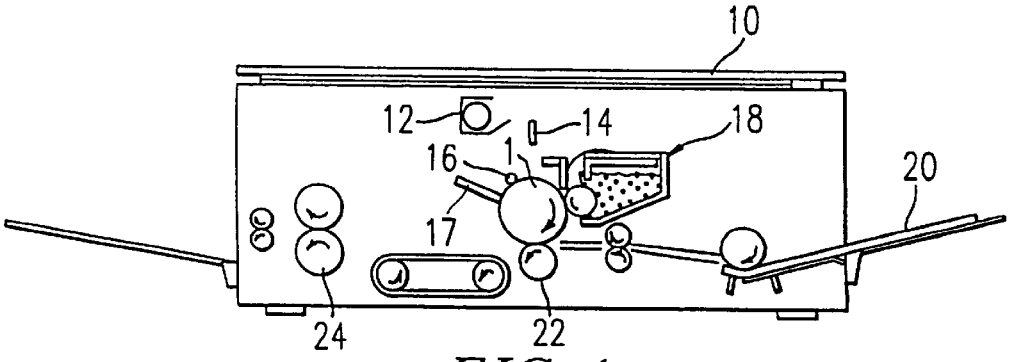
FIG. 1 schematically represents a photocopier to which the present invention is applicable.

FIG. 1 schematically represents an image forming apparatus in the form of a photocopier to which the present invention is applicable. In such an arrangement, an original document is placed upon the photocopier glass 10, and is illuminated by a lamp 12. The resulting light is then projected onto a photosensitive drum 1 by way of an optical system 14, and the drum has been previously charged utilizing a charge roller 16. As a result, an electrostatic latent image is formed on the drum 1, and a developing unit 18 then supplies toner to the drum 1 to develop the electrostatic latent image. Paper is fed from a source 20 by various rollers to a location between the drum 1 and a backup roller 22, so that the toner image of the drum is transferred to the paper. The paper is then fed to a fixing device 24 which, typically utilizing heat, fixes the toner image to the paper and the paper is then conveyed out of the apparatus. A cleaning blade 17 is provided downstream from the backup roller 22 (i.e., downstream with respect to the direction of rotation of the drum 1), so that any residual toner remaining on the drum after the image is transferred to the paper is removed by the cleaning blade 17. The toner removed by the blade then falls into a container (not shown) provided for collecting residual toner. The drum is then provided with an initial charge by the charge roller 16, and the process is repeated for the next image.

Figure 2:
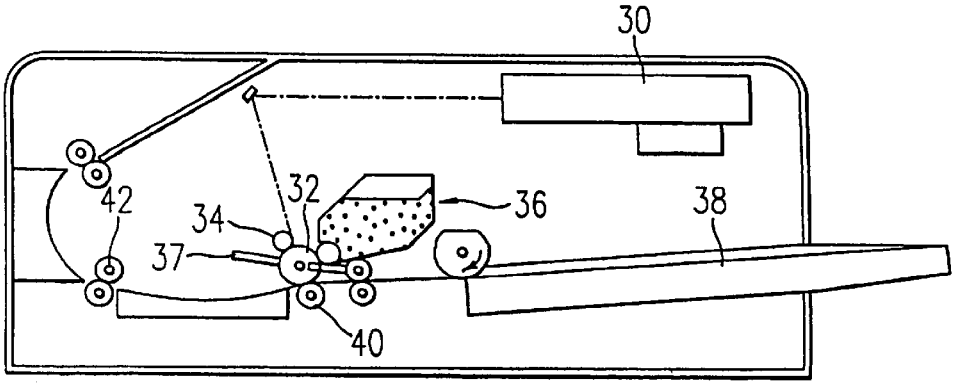
FIG. 2 schematically represents a printer to which the present invention is applicable.

FIG. 2 schematically represents a printer device to which the present invention is also applicable. As shown in FIG. 2, in contrast with the photocopier device, the printer provides an image by way of a control unit which provides a video signal, for example, by a laser scanning unit 30. The laser scanning unit 30 thus provides a latent image onto the photosensitive drum 32, which has been uniformly charged with a charge roller 34. The image is developed by a developing device 36, and is transferred to paper, which is fed from a source 38, as the paper passes between the photosensitive drum 32 and a backup roller 40. The paper then travels past a fixing device 42 and out of the printer by various conveying rollers and guides. Residual toner can be removed by a cleaning blade 37.

As should be apparent from the foregoing, the photosensitive drum is critical to the image forming process, and for each cycle of operation, the photosensitive drum is required to cooperate and interact with a number of components, including the charge roller, the optical image forming system, the developer device, the backup roller and the cleaning blade. As the drum rotates, it can also vibrate as a result of the drive utilized in rotating the drum, imperfections in the drum and/or the gear flanges of the drum, etc. Further, where an AC current is applied to the charge roller 16, 34, the alternating charge can also have a tendency to cause vibration and/or noise during operation of the drum, as can the frictional contact of the drum with the various components including the cleaning blade, charge roller and developing device. The operation of a charge roller has also been found to generate ozone gas by localized electric discharge (known as the Paschen discharge effect), and this discharge is also believed to be a potential cause for noise and/or vibration of the drum.

The generation of noise and/or vibration is often accompanied by a deterioration in the image quality, since the drum is not smoothly and consistently interacting with the other components of the image forming apparatus. As a result, toner may appear in areas in which it is not desired (undesirable black spots), and/or toner will not appear in areas required for forming the image (undesirable white spots). Less than optimal images can also occur over a period of use as the circularity of the drum diminishes. In particular, after the drum has operated for a number of cycles, certain locations of the drum can become deformed so that the cylindrical shape of the drum becomes more imperfect. This loss of circularity also contributes to degradation of the image quality, and the loss of circularity can occur more rapidly if the drum vibrates, since the drum can be exposed to more concentrated forces or forces of a larger magnitude than would be the case if the drum were smoothly rotated. Of course, the generation of undesirable noise and vibration can also be an annoyance to the operator of the apparatus, or those in the vicinity of the apparatus.

In order to avoid or reduce noise, some equipment manufacturers have designed the drum so that the natural resonance frequency of the drum does not match that of any of the surrounding components, and also so that the natural resonance frequency of the drum is not in the audible range. As a result, if vibration should occur, it is less destructive, since the frequency does not match that of the surrounding components. In addition, the noise is not audible (or is less likely to be audible) to the operator or those in the vicinity of operation of the apparatus. However, if a noise problem is found to occur in existing equipment, it can be quite costly to redesign tooling necessary to change the dimensions (e.g., the tube thickness) of the drum. Further, even if the tube thickness is modified, such a solution might not be satisfactory in addressing noise and/or vibration in all replacement parts situations, since the process cartridge (within which the drum is disposed) can vary with different manufacturers and models, and the manufacturer or refurbisher of process cartridges (or other components) is not always the same as that of the photosensitive drum.

Another approach to minimizing noise and/or vibration in photosensitive drums has been to insert a plug or weight at a predetermined location within the drum. However, the use of a plug-type insert can be undesirable in that the plug is typically required to be inserted at a particular axial location within the drum, and if improperly placed, the plug will not perform properly, and could even worsen the noise or vibration problems. In addition, the plug must be either adhered in place, or an interference fit can be utilized so that the plug is secured in place once inserted. Fixing the plug with an adhesive can be cumbersome, and could result in the adhesive being inadvertently disposed at locations other than desired, or the plug could shift if the drum is transported prior to curing of the adhesive. Bonding the insert to the drum also complicates recycling of the drum. If an interference fit is utilized, the drum could be deformed upon insertion. Further, since the drum is supported at the location of the plug, but not in other areas, the performance and response of the drum at the location of the plug might not be consistent with that of locations of the drum other than that where the plug is disposed.

Another problem that has arisen is that the photosensitive coatings on the outer surface of the drums can be damaged when they are engaged by tools used to hold the drum during a manufacturing process. Therefore, it has been known to use an expanding chuck to hold the drum while a process is being performed on it by expanding the expanding chuck against the inner surface of the drum. However, if a high insertion force is required for a particular insert, the expanding chuck must exert a correspondingly large radially outward force in order to overcome the insertion force, to thereby hold the drum in a proper orientation. Furthermore, if an insert requires a high insertion force because its outer diameter is larger than that of the inner diameter of the drum, the circularity of the drum can be distorted during insertion. Therefore, ideally, an insert is inserted with little or no insertion force, i.e., the insert only slightly touches or does not contact the inner surface of the drum during insertion.

Figure 3:
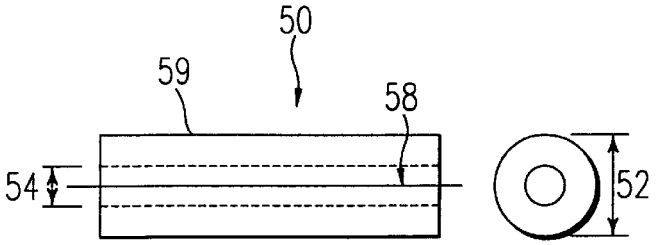
FIG. 3 includes a side and an end view of an insert according to the present invention.
Figure 4:
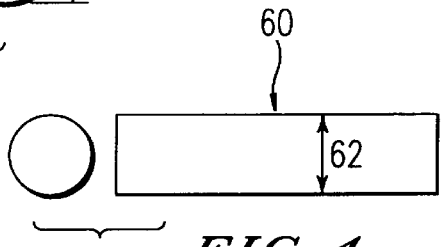
FIG. 4 is a side and an end view of a photoconductive drum of the present invention.

Referring now to FIGS. 3–6, insert 50, in accordance with the present invention, is shown therein. As shown in FIG. 3, insert 50 is preferably formed as a tubular member 59 having an outer diameter 52 and an inner diameter 54. As shown in FIG. 3, outer diameter 52 is the outer diameter of insert 50 in a relaxed state. Preferably, outer diameter 52 is larger than an inner diameter 62 of photosensitive drum 60, as shown in FIG. 4.

According to the invention, insert 50 is configured such that outer diameter 52 of insert 50 can be reduced to a diameter 56 which is less than or equal to inner diameter 62 of photosensitive drum 60, when insert 50 is elongated along its longitudinal axis 58. For example, referring now to FIG. 5, when insert 50 is elongated along its longitudinal axis 58 in the direction of arrows A, the outer diameter of insert 50 reduces to an outer diameter 56 which is less than or equal to inner diameter 62 of the photosensitive drum 60. Preferably, insert 50 is made from an elastic material which allows the outer diameter of insert 50 to reduce to diameter 56, which is less than or equal to inner diameter 62, when insert 50 is elongated in its longitudinal direction, within its elastic limits of distortion.

Figure 5:
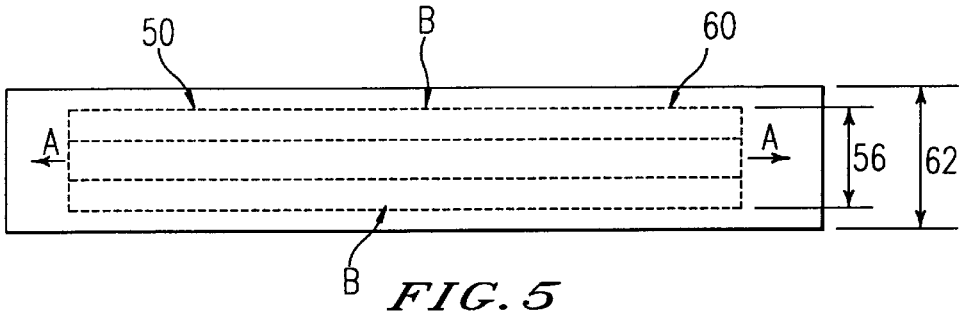
FIGS. 5 and 6 are side views of an insert according to the present invention positioned within a photoconductive drum.
Figure 6:
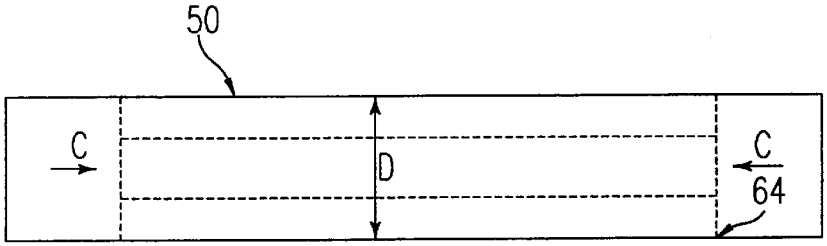

For example, it is well known in the art of solid mechanics that when an elastic member is stretched in a first direction, the elastic member will contract in a direction perpendicular to the first direction, so as to generally maintain a constant volume. As shown in FIG. 5, for example, when insert 50 is elongated in the direction of arrows A, the diameter of insert 50 shrinks in the direction of arrows B. As shown in FIG. 6, when insert 50 is released so as to allow insert 50 to return to a relaxed state, insert 50 contracts in the direction of arrows C, which thereby causes an expansion of its outer diameter in the direction of arrows D. Preferably, outer diameter 52 of insert 50 in a relaxed state, is chosen such that when insert 50 is provided within a photosensitive drum 60 as shown in FIG. 6, the outward radial force in the direction of arrows D is sufficient to anchor insert 50 within drum 60 so that it is not necessary to use an adhesive to ensure the immobilization of insert 50 with respect to drum 60.

Insert 50 may be formed of any elastic material. However, in a presently preferred embodiment, insert 50 is made from an elastomeric material such as neoprene. Preferably, the material used for insert 50 has an elastic elongation limit between 100%–500% and a yield strength between 10,000 to 100,000 psi. Insert 50 may also be constructed from a "filled" material, such as resin with carbon black added. By constructing an insert with such a material, a single insert can be sized to fit various sizes of photoconductive drums, thereby reducing the burden of stocking different sized inserts for different sized drums. Furthermore, such material is readily available and relatively easy to obtain in various sizes.

As an illustrative example of insert 50, neoprene tubing was formed with an outer diameter of approximately 30 mm in a relaxed state, a wall thickness of approximately 8 mm, and a weight of approximately 200 gm/ft. The tubing was stretched until the outer diameter was reduced to approximately 26 mm, and was then inserted into a photosensitive drum having an inner diameter of approximately 28 mm, thereby providing approximately 1 mm of clearance between the outer surface of the tubing and the inner surface of the drum. Once the tubing was moved to a desired position within the drum, the tubing was released and thereby allowed to expand and increase a pressure contact between the outer surface of the tubing and the inner surface of the drum. Since the outer diameter of the tubing in a relaxed state was 30 mm, and the inner diameter of the drum was 28 mm, the tubing provided an ample radially outward force for anchoring the tubing into the drum without the need for adhesive. Furthermore, since the tubing was elongated until there was a 2 mm difference between the outer diameter of the tubing and the inner diameter of the drum, the tubing could be inserted with zero insertion force.

Figure 7:
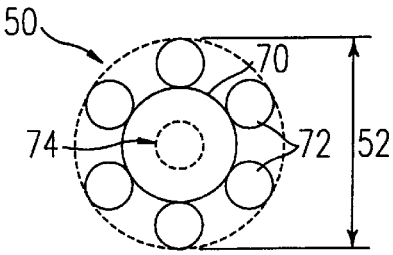
FIG. 7 is an alternative embodiment of an insert according to the present invention.

An alternative embodiment of insert 50 is shown in FIG. 7, wherein insert 50 is constructed with a first longitudinal member 70 and a plurality of longitudinally extending members 72 provided around the periphery of member 70. In this embodiment, as in the previous embodiment, it is preferable that an outer diameter 52 of insert 50 is greater than an inner diameter 62 of a photosensitive drum into which insert 50 is provided. In this embodiment, first longitudal member 70 may be in the form of a tubular member constructed of an elastic material. Similarly, longitudinally extending members 72 may be in the form of tubular or rod shaped members, not necessarily made of the same material as first longitudinal member 70. By constructing insert 50 as a tubular member, a shaft may be installed through the center 74 of insert 50 which is commonly used in image forming apparatuses.

Figure 8:
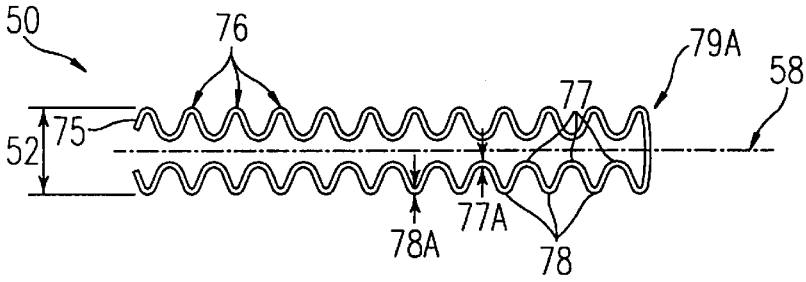
FIG. 8 is a sectional view of a further preferred embodiment of an insert according to the present invention.
Figure 9:
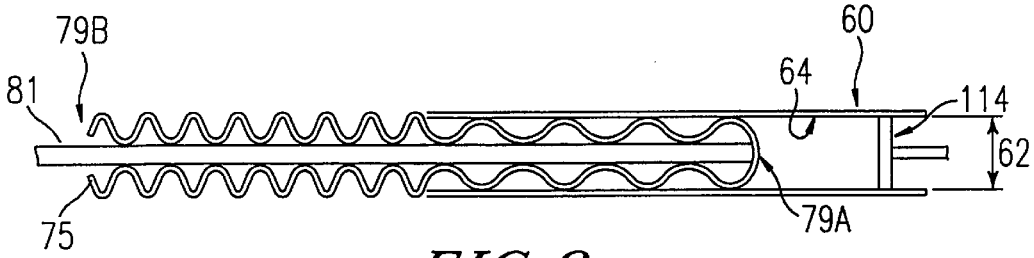
FIG. 9 is a sectional view of the insert shown in FIG. 8, during insertion into a photosensitive drum.
Figure 10:
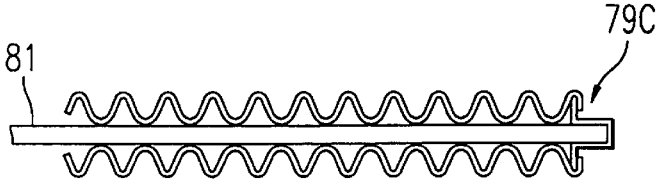
FIG. 10 is a sectional view of a further embodiment of the insert shown in FIG. 8.

A further embodiment of the insert is shown in FIGS. 8–10. As shown in the FIGS. insert 50 is constructed in the form of a corrugated sleeve 75. In the presently preferred embodiment, corrugated sleeve 75 has a corrugated shape defining a plurality of annular corrugations 76 formed along the longitudinal axis 58 of the insert 50. The corrugations 76 define inner folds 77 and outer folds 78. As illustrated in FIGS. 8 and 9, sleeve 75 has an outer diameter 52 that is greater than the inner diameter 62 of drum 60. By constructing sleeve 75 with corrugations as such, the outer diameter 52 of sleeve 75 is easily reduced upon elongation, as shown in FIG. 9. Furthermore, the corrugations provide a structure which is sufficiently elastic to generate a radially outward force for anchoring the insert 50 to the inner surface 64 of drum 60.

Preferably, a stiffness of sleeve 75 at the inner folds 77 is larger than a stiffness of the sleeve 75 at the outer folds 78. By constructing sleeve 75 as such, the degree of reduction of the outer diameter 52 of sleeve 75 achieved when sleeve 75 is elongated, is enhanced. For example, since the stiffness of sleeve 75 at the inner folds 77 is larger than that at the outer folds, the inner folds 77 resist expansion more than the outer folds 78. For example, as sleeve 75 is elongated, the inner folds 77 and outer folds 78 are expanded such that the inner folds move outwardly, and the outer folds move inwardly. Therefore, where the stiffness of the inner folds is larger than that of the outer folds, the outer folds are forced to deflect inwardly more than they would if the stiffness of the inner and outer folds were equal. Therefore, the overall radial contraction of sleeve 75 is enhanced when sleeve 75 is elongated along longitudinal axis 58. Preferably, in order to form inner folds 77 with a higher stiffness than outer folds 78, a thickness 77A of inner folds 77 is greater than a thickness 78A of outer folds 78A. For example, in a presently preferred embodiment, corrugated sleeve 75 may be made out of a widely available synthetic rubber, such as polybutadiene, with thickness 77A of approximately 1.0 mm and a thickness 78A of approximately 0.9 mm Also preferably, sleeve 75 has at least one closed end 79A. However, it is not necessary for closed end 79A to form a gas-tight closure. Rather, closed end 79A is preferably configured to serve as a stop for a tool used for elongating sleeve 75. For example, as shown in FIG. 9, a rod 81 may be used to elongate sleeve 75, by inserting rod 81 through open end 79B, until rod 81 abuts closed end 79A. In this position, rod 81 can be is pushed against closed end 79A to thereby elongate sleeve 75 such that the outer diameter 52 of sleeve 75 is sufficiently reduced to allow sleeve 75 to pass into drum 60. As shown in FIG. 9, since annular corrugations 76 allow sleeve 75 to be easily elongated, and thereby easily reduced in outer diameter, it is not necessary to anchor open end 79B of sleeve 75 during insertion. Rather, the natural resistance generated between the outer surface of sleeve 75 and the inner surface 64 of drum 60 is sufficient to cause elongation of sleeve 75 when closed end 79A is pushed through drum 60.

Alternatively, closed end 79A of sleeve 75 can be formed with an end plate which may be flat or in the form of a receptacle 79C, as shown in FIG. 10. By forming closed end 79A with receptacle 79C, the proper orientation of rod 81 during insertion is ensured.

Figure 11:
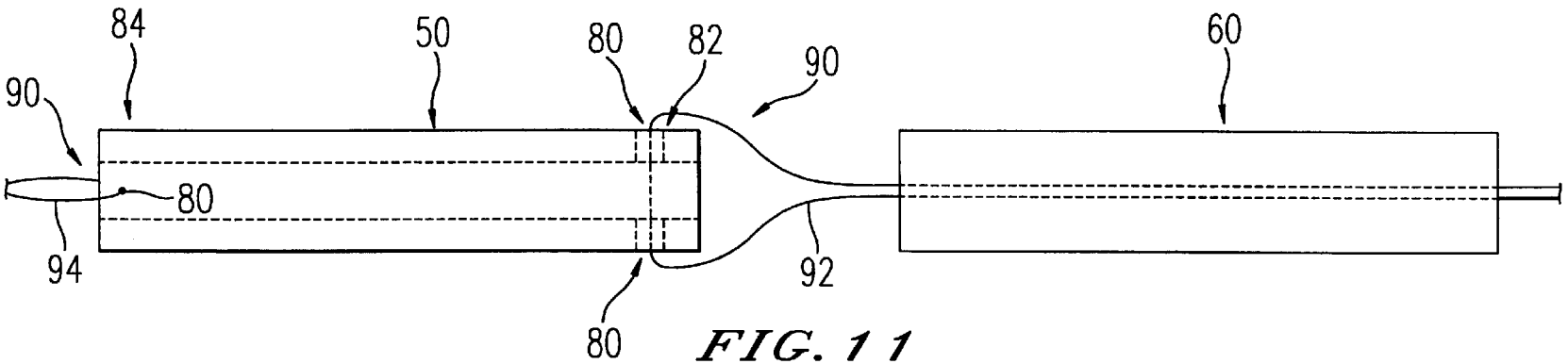
FIGS. 11 and 12 illustrate a method for inserting an insert into a photoconductive drum according to a further aspect of the present invention.
Figure 12:
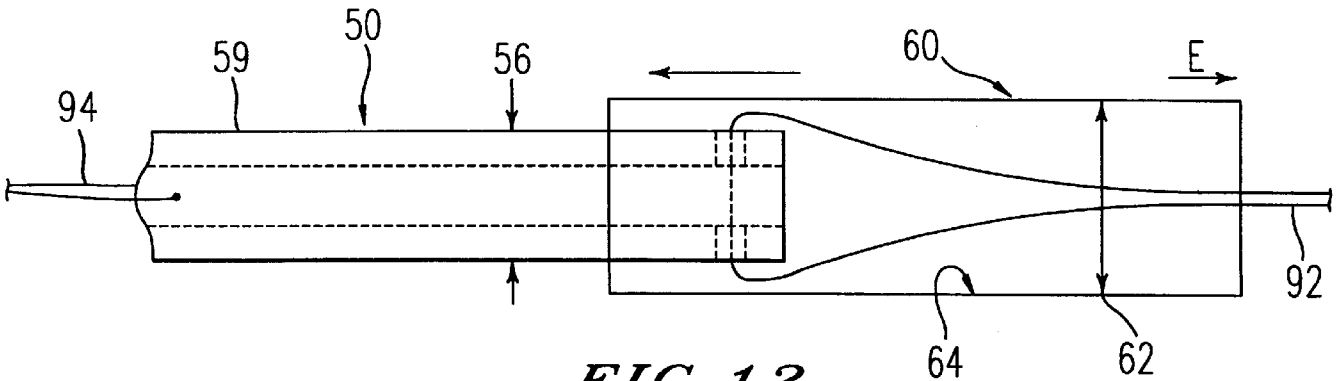

Referring now to FIGS. 9, 11 and 12, a method for inserting insert 50 into a photosensitive drum 60 will be described hereinbelow.

As shown in FIGS. 11 and 12, a method for inserting insert 50 into a photosensitive drum 60 includes elastically elongating insert 50 in a longitudinal direction, from a relaxed state wherein the insert has an outer diameter larger than an inner diameter of the photosensitive drum, such that an outer diameter of the insert is elastically reduced to a diameter equal to or less than the inner diameter of the photosensitive drum 60. Insert 50 is then inserted into the drum 60, wherein after insert 50 is released, and allowed to return to a relaxed state, a pressure contact of the outer surface of insert 50 with the inner surface of the photosensitive drum 60 increases. In the present embodiment, apertures 80 are formed in the first and second ends of insert 50, and engaging means 90 such as a wire cables 92 and 94 are interfaced with first end 82 and second end 84 of insert 50. Wire cable 92 is then threaded through photosensitive drum 60 and wire cable 94 is immobilized, with a vise, or the like (not shown). Tension is then applied to wire cable 92 in the direction of arrow E, as shown in FIG. 12, so as to cause insert 50 to elastically elongate such that the outer diameter of insert 50 reduces to an outer diameter 56 which is equal to or less than inner diameter 62 of photosensitive drum 60. Once insert 50 has been elongated as Such, drum 60 can be moved over insert 50 until insert 50 is inside drum 60. Once insert 50 is positioned as desired, wire cables 92 and 94 can then be released such that the outer diameter of insert 50 expands in the direction of arrows D, shown in FIG. 6, and thereby increases a pressure contact between the inner surface 64 of drum 60 and outer surface 59 of insert 50.

Figure 13:
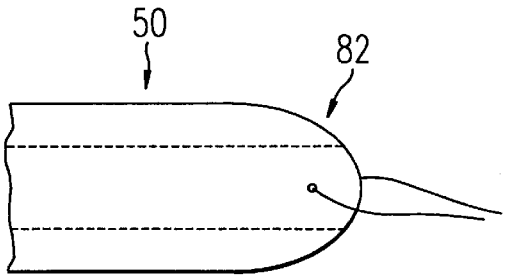
FIG. 13 is an enlarged side view of one end of an insert according to the present invention.

When drum 60 is moved over insert 50, as shown in FIG. 12, a misalignment between photosensitive drum 60 and insert 50 may cause first end 82 of insert 50 to lock against an end of drum 60, thereby preventing drum 60 from sliding over insert 50. Therefore, as shown in FIG. 13, first end 82 of insert 50 is preferably rounded so that the insertion of insert 50 into drum 60 is simplified.

Referring now to FIG. 9, as discussed above, sleeve 75 can be elongated by inserting a tool such as rod 81 through open end 79B, and against closed end 79A. As shown in FIG. 9, the friction generated by contact between the outer surface of sleeve 75 and the inner surface 64 of photosensitive drum is sufficient for causing, when rod 81 is pressed against closed end 79A, the elongation of sleeve 75 such that the outer diameter 52 of sleeve 75 is reduced such that sleeve 75 can slide into drum 60. Alternatively, open end 79B of sleeve 75 could be anchored by hand or machine, such that sleeve 75 is elongated to such an extent that the outer diameter 52 of sleeve 75 is reduced to a diameter smaller than that of the inner surface 64 of drum 60. By performing the method of inserting as Such, sleeve 75 can be inserted without generating any substantial friction with the inner surface 64 of drum 60.

Figure 14:
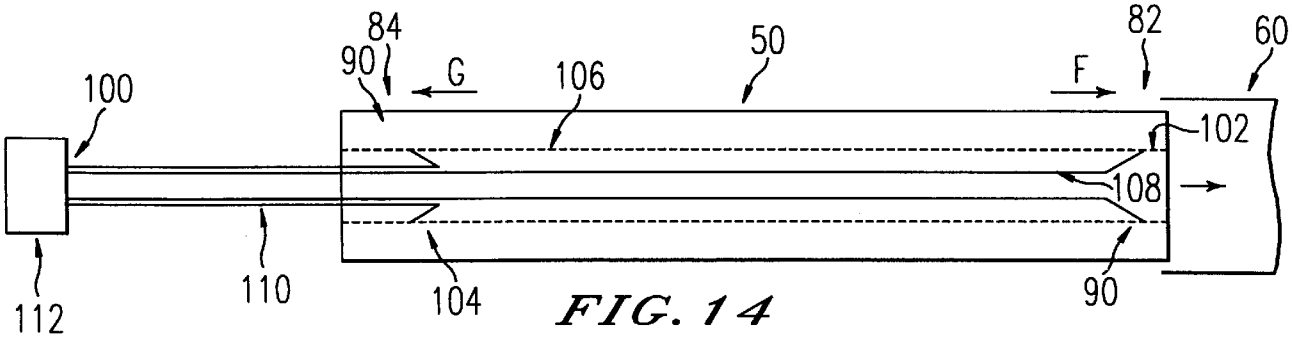
FIGS. 14 and 15 illustrate a method of inserting an insert into a photoconductive drum according to a further embodiment of the present invention.
Figure 15:
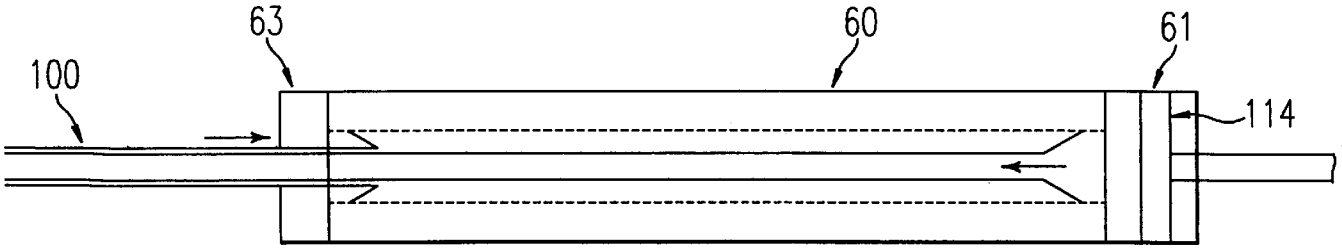

Referring now to FIGS. 14 and 15, a further embodiment of the method for inserting an insert 50 into photosensitive drum 60 is shown therein. As shown in FIG. 14, a tool 100 for elongating insert 50 may include engaging means 90 for engaging first end 82 and second end 84 of insert 50. In this embodiment, engaging means 90 may be constructed of expanding chucks 102 and 104. Each of expanding chucks 102 and 104 may be constructed with three way (or more) expanding chucks which are configured to engage with the inner surface 106 of insert 50. Expanding chuck 102 may be attached to first arm 108 and expanding chuck 104 may be attached to second arm 110. In this embodiment, arms 108 and 110 are attached to device 112 which is configured to move arms 108 and 110 relative to each other in a longitudinal direction and to control the expansion of chucks 102 and 104. In operation, with expanding chuck 102 engaged with the inner surface 106 of first end 82 of insert 50 and expanding chuck 104 engaged with inner surface 106 of second end 84 of insert 50, first arm 108 of tool 100 can be moved in the direction of arrow F while second arm 110 may be moved in the direction of arrow G so as to elongate insert 50. By using device 110 constructed as such, there are no components to interfere with the insertion of drum 60 over insert 50. Therefore, drum 60 may be held from a first end 61 of drum 60 with an expanding chuck 114, for example, while tool 100 can be used to elongate insert 50 and insert insert 50 into drum 60 from second end 63 of drum 60. Using this method, insert 50 may be inserted into drum 60 without the need to contact any portion of the outer surface of drum 60, thereby preventing damage to the outer surface of drum 60.

Similarly, as shown in FIG. 9, expanding chuck 114 can be used to maintain the position of drum 60 while sleeve 75 is inserted therein. Since sleeve 75 requires little or no insertion force, an expanding chuck is sufficient for overcoming the forces generated during insertion of sleeve 75.

Figure 16:
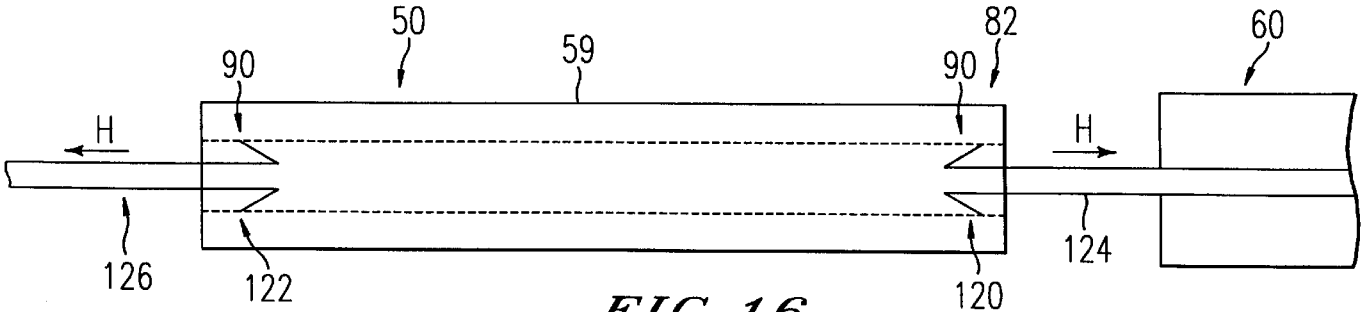
FIGS. 16 and 17 show a method for inserting an insert into a photoconductive drum according to a further embodiment of the present invention.
Figure 17:
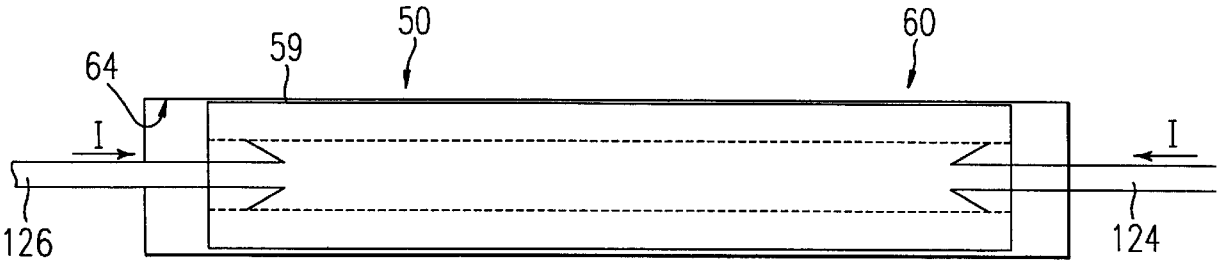

Referring now to FIGS. 16 and 17, a further embodiment of a method for inserting an insert into a photosensitive drum is shown. As shown in FIG. 16, engaging means 90, such as expanding jigs 120 and 122 may be provided on arms 124 and 126 so as to elongate insert 50 in direction of arrows H so that insert 50 can be inserted into drum 60, as shown in FIG. 14. In this embodiment, drum 60 must be threaded over arm 124, similarly to the embodiment shown in FIGS. 11 and 12 wherein drum 60 is threaded over wire cable 92. Also as shown in FIG. 17, once insert 50 has been positioned within drum 60, arms 124 and 126 can be moved towards each other in the direction of arrows I so that insert 50 can expand and thereby increase a pressure contact between inner surface 64 of drum 60 and outer surface 59 of insert 50. In this embodiment, it is also preferable to provide first end 82 with a rounded shape, such as that shown in FIG. 13, so that insert 50 can be inserted into drum 60 with reduced risk that first end 82 may impact an end of drum 60 during insertion.

Figure 18:
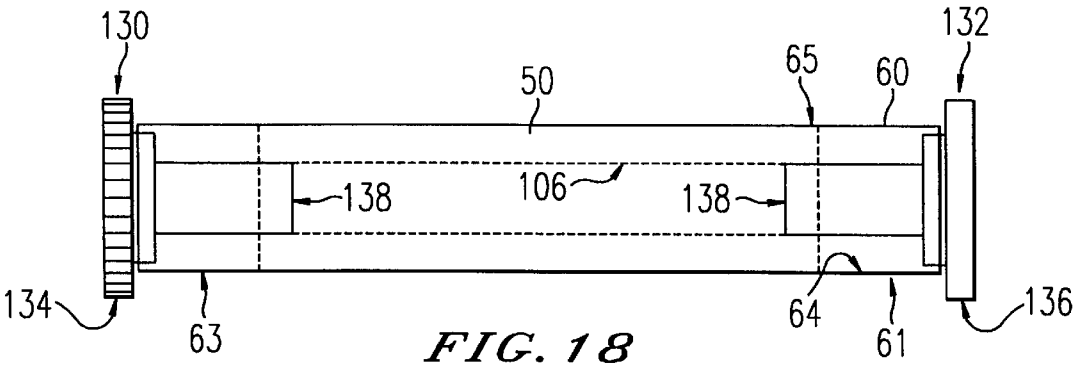
FIG. 18 is a side view of a further embodiment of the present invention.

Referring now to FIG. 18. once insert 50 has been inserted into drum 60, first and second ends 61 and 63 of drum 60 can be provided with end pieces 130 and/or 132. End pieces 130 and/or 132 may be in the form of a gear 134 and/or flange 136. Typically, gear 134 is provided to a drum 60 so as to provide an interface to a motor (not shown) for driving drum 60. Flange 136, is typically provided so as to provide a bearing surface for supporting drum 60. Alternatively, end 61 of drum 60 could be provided with a gear 134 which may be used for driving other rollers or gears. In any event, typically gears 134 and/or flanges 136 must be bonded to the inner surface 64 of drum 60 with an adhesive. However, use of an adhesive raises a number of problems in the manufacture of photosensitive drums.

For example, if adhesive must be used during the manufacture of photosensitive drum 60, the risk that adhesive may be splashed onto the outer surface 65 of drum 60, is increased, which may require that drum 60 be immediately discarded. Furthermore, adhesives on the outer surface may affect the photosensitivity and/or performance of drum 60 in operation. Furthermore, when an adhesive is used to bond a component to a drum such as drum 60, it is difficult to remove such components when a drum 60 is to be recycled. Therefore, it is desirable to avoid the use of adhesives.

In light of the problems of using adhesives for bonding end pieces to photosensitive drums, in one embodiment of the present invention, gears 134 and/or flanges 136 may be bonded directly to insert 50, after insert 50 has been inserted into drum 60. For example, as shown in FIG. 18, gear 134 and flange 136 may include connecting member 138 which is engaged with inner surface 106 of insert 50. Therefore, by attaching end pieces 130 and/or 132 with insert 50, gear 134 and/or flange 136 can be attached to drum 60 without the use of adhesives directly bonded to a surface of drum 60.

After insert 50 is disposed within drum 60, and end pieces 130 and 132 such as gear 134 and/or flange 136 are mounted to each end of the drum 60, drum 60 can then be rotatably mounted upon a shaft (if a shaft is utilized, and disposed within a process cartridge to be utilized in a photocopier or printer).

As discussed above, the present invention provides several important advantages over noise reducing inserts of the prior art. Firstly, by constructing a noise prevention device for a photosensitive drum from an elastic member which has an outer diameter greater than the inner diameter of the drum in a relaxed state, and which is configured such that it can be elastically elongated and thereby reduced in outer diameter to be smaller than the inner diameter of the drum, the present invention achieves the dual goals of providing a noise reducing insert that can be inserted with little or no insertion force, while generating the relatively high radially outward force produced by an interference fit. Furthermore, since the outer diameter of the insert in a relaxed state is larger than the inner diameter of the drum, and since materials which can be elastically distorted as described above tend to possess good noise dampening properties, the insert provides numerous points of contact between the insert and the inner surface of the drum, thereby achieving a strong noise dampening effect.

Additionally, since the insert according to the present invention can be used to absorb the vibrations and noises generated during operation of an image forming apparatus which uses the insert, there is no need to increase the thickness of the drum. Therefore, the present invention also allows the drum to be manufactured with virtually any thickness currently used for image forming apparatuses.

Obviously, numerous modifications and variations of the present invention are possible in light of the above teachings. It is therefore to be understood that, within the scope of the appended claims, the invention may be practiced otherwise and as specifically described herein.

What is claimed as new and desired to be secured by Letters Patent of the United States is:

1. A photosensitive drum for an image forming apparatus comprising:

(a) a tubular photosensitive member having:
(i) an outer photosensitive surface; and
(ii) an inner surface;

(b) a noise prevention device comprising an elastic member disposed inside of said tubular photosensitive member, said elastic member having, in a relaxed state, an outer diameter larger than an inner diameter of said inner surface of said tubular photosensitive member, said elastic member configured such that when said elastic member is elongated in a longitudinal direction, said outer diameter of said elastic member may be elastically reduced to a diameter less than said inner diameter of said tubular photosensitive member; and wherein said elastic member comprises a first end and a second end, and wherein at least one of said first and second ends includes an aperture directed substantially perpendicular to a longitudinal axis of the elastic member.

2. A photosensitive drum as recited in claim 1, wherein said elastic member comprises a tubular member made of an elastomeric material.

3. A photosensitive drum as recited in claim 1, wherein each of said first and second ends includes an aperture extending substantially perpendicular to a longitudinal axis of the elastic member.

4. A photosensitive drum according to claim 1, wherein said elastic member comprises a first end having a rounded shape.

5. A photosensitive drum as recited in claim 1, wherein said elastic member comprises a corrugated sleeve.

6. A photosensitive drum as recited in claim 1, wherein said elastic member comprises a plurality of annular corrugations.

7. A photosensitive drum for an image forming apparatus comprising:

(a) a tubular photosensitive member having:
(i) an outer photosensitive surface; and
(ii) an inner surface;

(b) a noise prevention device comprising an elastic member disposed inside of said tubular photosensitive member, said elastic member having in a relaxed state, an outer diameter larger than an inner diameter of said inner surface of said tubular photosensitive member, said elastic member configured such that when said elastic member is elongated in a longitudinal direction, said outer diameter of said elastic member may be elastically reduced to a diameter less than said inner diameter of said tubular photosensitive member; and wherein said elastic member comprises a first member having a longitudinal axis and a plurality of longitudinally extending members provided around a periphery of said first member.

8. A photosensitive drum according to claim 7, wherein said longitudinally extending members are bonded to the outer periphery of said first member.

9. A photosensitive drum according to claim 7, wherein said longitudinally extending members are made of an elastomeric material and are attached to the outer periphery of said first member.

10. A photosensitive drum for an image forming apparatus comprising:

(a) a tubular photosensitive member having:
(i) an outer photosensitive surface; and
(ii) an inner surface;

(b) a noise prevention device comprising an elastic member disposed inside of said tubular photosensitive member, said elastic member having, in a relaxed state, an outer diameter larger than an inner diameter of said inner surface of said tubular photosensitive member, said elastic member configured such that when said elastic member is elongated in a longitudinal direction, said outer diameter of said elastic member may be elastically reduced to a diameter less than said inner diameter of said tubular photosensitive member; and wherein said elastic member comprises a corrugated sleeve, and said corrugated sleeve includes inner folds defining an inner diameter and outer folds defining an outer diameter of the sleeve, wherein a stiffness of at least one inner fold is larger than a stiffness of at least one outer fold.

11. A photosensitive drum according to claim 10, wherein a thickness of said sleeve at said at least one inner fold is larger than a thickness of said sleeve at said at least one outer fold.

12. A method for reducing at least one of noise and vibration in an image forming apparatus comprising:

elastically elongating an insert in a longitudinal direction of the insert, from a relaxed state wherein the insert has an outer diameter larger than an inner diameter of a photosensitive member, such that an outer diameter of the insert is elastically reduced to a diameter equal to or less than the inner diameter of the photosensitive member;

inserting the elongated insert into the photosensitive member; and allowing the insert to return to a relaxed state such that a pressure contact of an outer surface of the insert with an inner surface of the photosensitive member increases;

wherein said step of elastically elongating comprises engaging a first end of the insert with a first engaging means, engaging a second end of the insert with a second engaging means, and moving said first and second engaging means so as to elongate the insert.

13. A method as recited in claim 12, wherein said step of elastically elongating comprises elongating the insert such that the outer diameter of the insert is reduced to a diameter less than the inner diameter of the photosensitive member.

14. A method as recited in claim 12, wherein said step of inserting comprises threading the photosensitive member over said first engaging means and around the insert.

15. A method as recited in claim 12, wherein said first and second engaging means are inserted into an interior of said insert from either one of said first or second ends.

16. A method as recited in claim 12, wherein said step of elastically elongating and said step of inserting are performed simultaneously.

17. An image forming apparatus comprising:

(a) a photosensitive drum which includes a tubular photosensitive member, said tubular photosensitive member having an inner surface and an outer surface; and (b) a noise prevention device comprising an elastic member disposed inside of said tubular photosensitive member, said elastic member having, in a relaxed state, an outer diameter larger than an inner diameter of said inner surface of said tubular photosensitive member, said elastic member configured such that when said elastic member is elongated in a longitudinal direction, said outer diameter of said elastic member is elastically reduced to a diameter equal to or less than said inner diameter of said tubular photosensitive member;

wherein said elastic member comprises a first end and a second end, and wherein at least one of said first and second ends includes an aperture directed substantially perpendicular to a longitudinal axis of the elastic member.

18. An image forming apparatus as recited in claim 17, wherein said elastic member comprises a tubular member made of an elastomeric material.

19. An image forming apparatus as recited in claim 17, wherein each of said first and second ends includes an aperture extending substantially perpendicular to a longitudinal axis of the elastic member.

20. An image forming apparatus according to claim 17, wherein said elastic member comprises a first end having a rounded shape.

21. An image forming apparatus as recited in claim 17, wherein said elastic member comprises a corrugated sleeve.

22. An image forming apparatus as recited in claim 17, wherein said elastic member comprises a plurality of annular corrugations.

23. An image forming apparatus comprising:

(a) a photosensitive drum which includes a tubular photosensitive member, said tubular photosensitive member having an inner surface and an outer surface; and (b) a noise prevention device comprising an elastic member disposed inside of said tubular photosensitive member, said elastic member having, in a relaxed state, an outer diameter larger than an inner diameter of said inner surface of said tubular photosensitive member, said elastic member configured such that when said elastic member is elongated in a longitudinal direction, said outer diameter of said elastic member is elastically reduced to a diameter equal to or less than said inner diameter of said tubular photosensitive member;

wherein said elastic member comprises a first member having a longitudinal axis and a plurality of longitudinally extending members provided around a periphery of said first member.

24. An image forming apparatus according to claim 23, wherein said longitudinally extending members are bonded to the outer periphery of said first member.

25. An image forming apparatus according to claim 23, wherein said longitudinally extending members are made of an elastomeric material and are attached to the outer periphery of said first member.

26. An image forming apparatus comprising:

(a) a photosensitive drum which includes a tubular photosensitive member, said tubular photosensitive member having an inner surface and an outer surface; and (b) a noise prevention device comprising an elastic member disposed inside of said tubular photosensitive member, said elastic member having, in a relaxed state, an outer diameter larger than an inner diameter of said inner surface of said tubular photosensitive member, said elastic member configured such that when said elastic member is elongated in a longitudinal direction, said outer diameter of said elastic member is elastically reduced to a diameter equal to or less than said inner diameter of said tubular photosensitive member;

wherein said elastic member comprises a corugated sleeve, and said corrugated sleeve includes inner folds defining an inner diameter and outer folds defining an outer diameter of the sleeve, wherein a stiffness of at least one inner fold is larger than a stiffness of at least one outer fold.

27. An image forming apparatus according to claim 26, wherein a thickness of said sleeve at said at least one inner fold is larger than a thickness of said sleeve at said at least one outer fold.

28. A tool comprising:

a first engaging device;

a second engaging device;

a controlling device connected with said first and second engaging devices, said controlling device configured to move said first and second engaging devices relative to each other.

29. A tool according to claim 28, wherein said first and second engaging devices are expanding chucks.

30. A tool according to claim 29, wherein said first and second engaging devices are mounted respectively to first and second arms which are connected to said controlling device.

31. A tool according to claim 30, wherein said second arm is mounted coaxially with said first arm to said controlling device.

32. A tool according to claim 31, wherein said controlling device is configured to control a first expanding chuck and a second expanding chuck to selectively expand and thereby engage an inner surface of first and second ends of an elastomeric insert, and to move said first and second arms relative to each other along a first direction with sufficient force to elongate the elastomeric insert, such that an outer diameter of the elastomeric insert is contracted.

33. A tool according to claim 30, wherein said controlling device is configured to move said first and second arms relative to each other along a first direction.

34. A tool according to claim 28, wherein said first and second engaging devices are configured to engage an inner surface of an elastomeric insert for a photoconductive drum.

35. A tool according to claim 34, wherein said controlling device is configured to control a first engaging device and a second engaging device to selectively engage with first and second ends of the elastomeric insert, and to move said first and second arms relative to each other along a first direction with sufficient force to elongate the elastomeric insert, such that an outer diameter of the elastomeric insert is contracted.

36. A photosensitive drum for an image forming apparatus comprising:

(a) a tubular photosensitive member having:
(i) an outer photosensitive surface; and
(ii) an inner surface;

(b) a noise prevention device comprising an elastic member disposed inside of said tubular photosensitive member, said elastic member having, in a relaxed state, an outer diameter larger than an inner diameter of said inner surface of said tubular photosensitive member, wherein said elastic member comprises a plurality of annular corrugations, each of said annular corrugations extending circumferentially around said elastic member, and wherein said annular corrugations include inner folds and outer folds, with said outer folds defining said outer diameter of said elastic member, such that when said elastic member is elongated in a longitudinal direction, said elastic member is elongated by at least partial unfolding of said liner and outer folds and said outer diameter of said elastic member is thereby reduced to a diameter equal to or less than said inner diameter of said tubular photosensitive member to ease insertion of said noise prevention device into said tubular photosensitive member.

37. A method for reducing at least one of noise and vibration in an image forming apparatus comprising:

providing an insert having, in a relaxed state, an outer diameter larger than an inner diameter of a tubular photosensitive member, wherein said insert comprises an elastic member having a plurality of annular corrugations, each of said annular corrugations extending circumferentially around said elastic member, and wherein said annular corrugations include inner folds and outer folds, wherein said outer folds define said outer diameter of said insert;

elastically elongating said insert in a longitudinal direction of the insert such that said insert is elongated by at least partial unfolding of said inner and outer folds and the outer diameter of the insert is thereby elastically reduced to a diameter equal to or less than the inner diameter of the photosensitive member to ease insertion of said insert into said photosensitive member;

inserting the elongated insert into the photosensitive member;

allowing the insert to return to a relaxed state such that a pressure contact of an outer surface of the insert with an inner surface of the photosensitive member increases.

38. An image forming apparatus comprising:

(a) a photosensitive drum which includes a tubular photosensitive member, said tubular photosensitive member having an inner surface and an outer surface; and (b) a noise prevention device comprising an elastic member disposed inside of said tubular photosensitive member, said elastic member having, in a relaxed state, an outer diameter larger than an inner diameter of said inner surface of said tubular photosensitive member, wherein said elastic member comprises a plurality of annular corrugations, each of said annular corrugations extending circumferentially around said elastic member, and wherein said annular corrugations include inner folds and outer folds, with said outer folds defining said outer diameter of said elastic member, such that when said elastic member is elongated in a longitudinal direction, said elastic member is elongated by at least partial unfolding of said inner and outer folds and said outer diameter of said elastic member is thereby reduced to a diameter equal to or less than said inner diameter of said tubular photosensitive member to ease insertion of said noise prevention device into said tubular photosensitive member.

* * * * *